US005716010A

United States Patent [19]

Tada et al.

[11] Patent Number: 5,716,010

[45] Date of Patent: Feb. 10, 1998

[54] ELECTROMAGNETIC FUEL INJECTION VALVE

[75] Inventors: Ryoichi Tada, Oobu; Hideto Takeda, Kariya; Hideo Kiuchi, Hoi-gun; Nobuo Ota, Takahama, all of Japan

[73] Assignee: Nippondenso Co., Ltd., Kariya, Japan

[21] Appl. No.: 538,233

[22] Filed: Oct. 3, 1995

[30] Foreign Application Priority Data

Oct. 3, 1994 [JP] Japan ..... 6-264557

[51] Int. Cl.[6] ..... B05B 1/30; B05B 9/00

[52] U.S. Cl. ..... 239/585.1; 239/124; 251/129.21

[58] Field of Search ..... 251/129.21, 284; 239/585.1, 585.3, 585.4, 585.5, 124

[56] References Cited

U.S. PATENT DOCUMENTS

| | | | |
|---|---|---|---|
| 4,700,891 | 10/1987 | Hans et al. | 239/585 |
| 4,717,080 | 1/1988 | Sauer | 239/585 |
| 5,222,674 | 6/1993 | Hans et al. | 239/585.1 X |

FOREIGN PATENT DOCUMENTS 1-41828 9/1989 Japan .

*Primary Examiner*—Andres Kashnikow
*Assistant Examiner*—Robin O. Evans
*Attorney, Agent, or Firm*—Cushman, Darby & Cushman IP Group of Pillsbury, Madison & Sutro LLP

[57] ABSTRACT

An electromagnetic fuel injection valve prevents fuel bubbles from staying at a downstream side of the valve's stopper plate and helps to inject fuel smoothly. The electromagnetic injection valve includes a needle having a valve head opening and closing a valve seat, an electromagnetic coil portion for actuating the needle electromagnetically and a contact portion disposed at the downstream side of the stopper plate on the needle. The stopper plate includes a notch accommodating the needle therein and bubble discharge surfaces made outwardly from the notch to discharge bubbles produced at the downstream side of the contact portion toward the upstream side thereof and help the fuel flow smoothly.

16 Claims, 9 Drawing Sheets

ELECTROMAGNETIC FUEL INJECTION VALVE

CROSS REFERENCE TO RELATED APPLICATION

This application is based on and claims priority of Japanese Patent Application No. 6-264557 filed Oct. 3, 1994, the content of which is incorporated herein by reference.

BACKGROUND OF THE INVENTION

1. Field of the Invention

The present invention relates to an electromagnetic injection valve and particularly relates to a position and a construction of a stopper plate of the electromagnetic injection valve.

2. Description of Related Art

An electromagnetic injection valve is, for example, a valve for injecting fuel into an automotive engine, and therefore, many kinds of structures thereof are proposed.

As shown in FIGS. 14 through 16, conventionally, an electromagnetic injection valve 9 includes a needle 92 having a valve head 97 opening and closing a valve seat 941, an electromagnetic coil (not shown in these figures) actuating the needle 92 electromagnetically and a stopper plate 8 held by a housing 91. The stopper plate 8 is fixed between the housing 91 and a nozzle body 94.

The needle 92 has a contact portion 93 contacting the stopper plate 8 below (with reference to FIG. 14) the stopper plate 8. The contact portion 93 abuts the stopper plate 8 when the value is open to limit clearance between the valve head 97 and the valve seat 941.

As shown in FIG. 15, the stopper plate 8 includes an opening hole 83 accommodating the needle 92 therein and three fuel flowing holes 81. The fuel flowing holes 81 help the fuel flow smoothly between an upstream side and the downstream side of the stopper plate 8 and prevent pulsation of the fuel while flowing (see, e.g., Japanese Examined Patent Publication No. 1-41828).

In the conventional electromagnetic injection valve, as shown in FIG. 14, the needle 92 is supported by two guide portions 961 and 962 at a portion below the stopper plate 8. The needle 92 terminates in a fuel injection nozzle 943 and pintle portion 971 as shown in FIG. 14.

Although the electromagnetic injection valve is mounted, for example, on an engine or a manifold, a tip end of the valve head 97 is heated by transmission of engine combustion heat. Therefore, fuel in a periphery of the valve head 97 generates bubbles by being heated.

As shown in FIG. 16, bubbles 90 rise toward the stopper plate 8 and stay at a hollow portion 940 between the stopper plate 8 and an opening portion 945 of the nozzle body 94. Since the fuel flowing holes 81 are positioned more inward than the opening portion 945 of the nozzle body 94, when the fuel injection valve is mounted at an inclination, the amount of bubbles staying at the hollow portion 940 is increased. The fine bubbles grow larger, and therefore, the bubbles cover a portion of one of the fuel flowing holes 81. Thus, smooth flowing of the fuel is interrupted. Particularly, when the engine is started with a high temperature, the bubbles are easily produced, and therefore, re-starting the engine is made more difficult.

The stopper plate 8 can be disposed at the tip end of the nozzle body 94, that is, around the periphery of the valve head 97. However, in this case, since the tip end of the nozzle body 94 is heated up to a high temperature as described before, heat is transmitted to the fuel through the stopper plate 8. Therefore, the fuel downstream of the stopper plate 8 is heated and even more bubbles are produced. As a result, fuel injection cannot be carried out smoothly.

SUMMARY OF THE INVENTION

In view of the foregoing problems of the prior art, it is a primary purpose of the invention to provide an electromagnetic injection valve preventing fuel bubbles from staying at a downstream side of the valve's stopper plate.

The above purpose is achieved by providing an electromagnetic injection valve preventing fuel bubbles from staying at a downstream side of the valve's stopper plate and helping to inject fuel smoothly. The electromagnetic injection valve includes a housing, a needle having a valve head opening and closing a valve seat and an electromagnetic coil portion for actuating the needle electromagnetically and displacing the needle along an axis thereof. The needle includes a contact portion and a stopper plate having a notch accommodating the needle therein and bubble discharge surfaces made outwardly from the notch to pass fuel produced at the downstream side of the contact portion toward the upstream side thereof and help the fuel flow smoothly.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

An electromagnetic injection valve in a first embodiment of the present invention is explained with reference to FIGS. 1 through 6.

The electromagnetic injection valve of the present embodiment is applied to a fuel injection valve of a fuel supply device of an automotive engine. The electromagnetic injection valve is mounted at an intake passage of the engine, injects fuel into engine intake air and forms an air-fuel mixture which is easily ignited and burns well inside the engine's combustion chamber.

Figure 1:
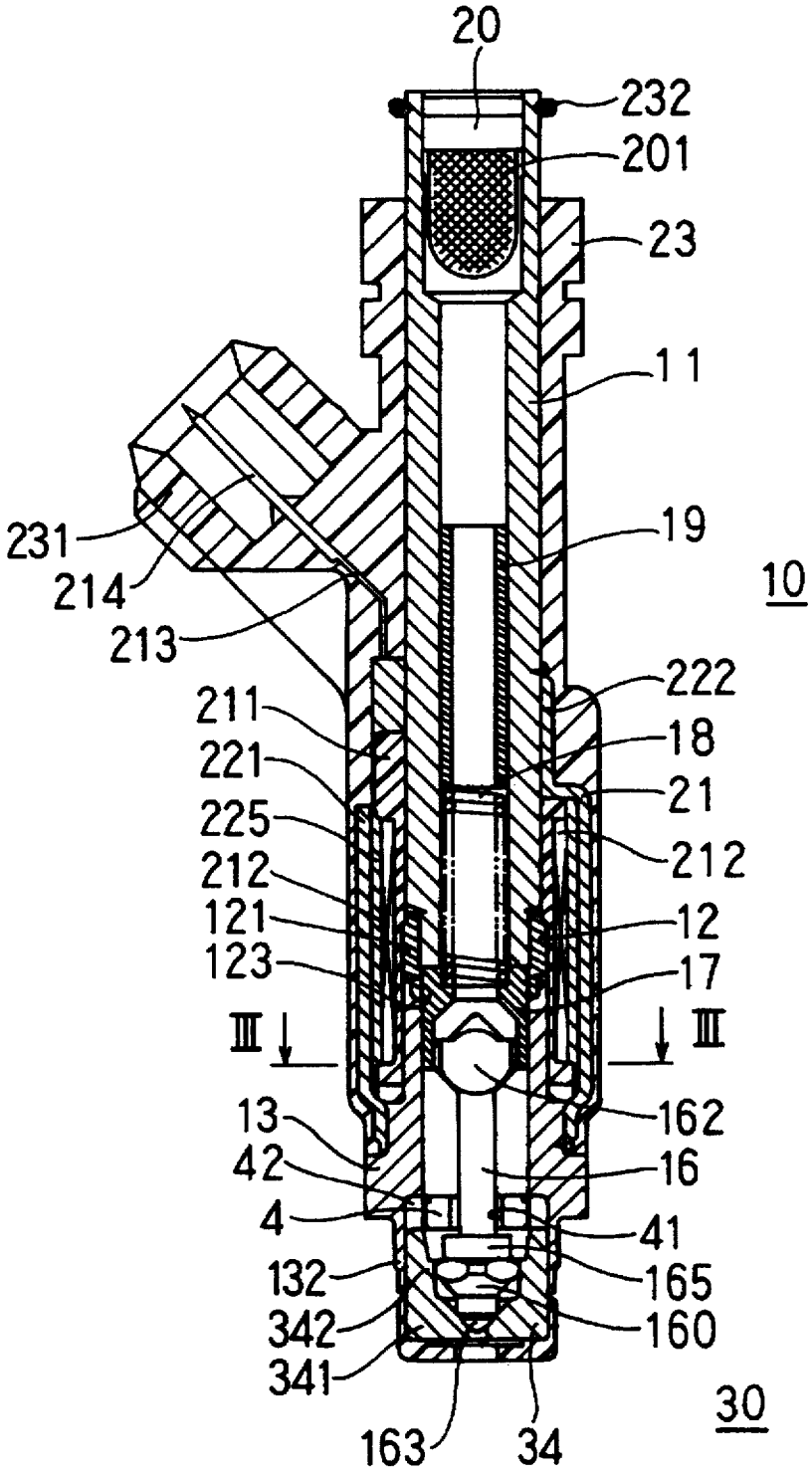
FIG. 1 is a cross-sectional view illustrating an electromagnetic injection valve according to a first embodiment of the present invention.
Figure 2:
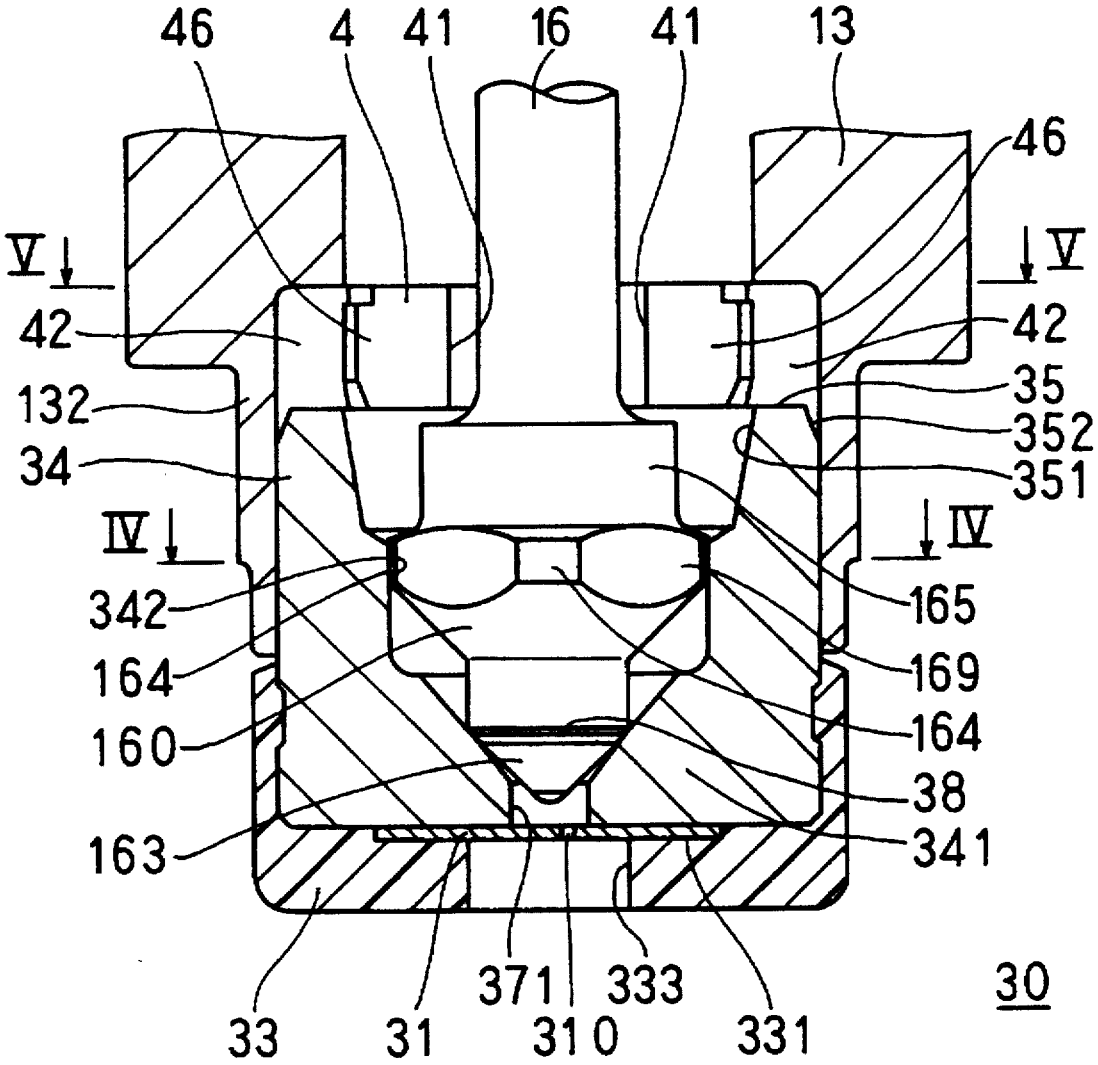
FIG. 2 is an enlarged longitudinal cross-sectional view illustrating a nozzle portion of the electromagnetic injection valve according to the first embodiment of the present invention.

As shown in FIGS. 1 and 2, the electromagnetic injection valve includes a needle 16 having a valve head 160 for opening and closing a valve seat 341 installed on a nozzle body 34, an electromagnetic coil portion 21 for actuating the needle 16 electromagnetically and guide portions 123 and 342 provided at two places in a vertical direction to guide a movement of the needle 16 in an axial direction. Between the guide portions 123 and 342, the electromagnetic injection valve further includes a stopper plate 4 held in a housing 13 and a contact portion 165 disposed on a downstream side of the stopper plate 4 on the needle 16.

As shown in FIGS. 1, 2, 5, and 6, the stopper plate 4 has a notch 41 for accommodating the needle 16 therein and cooperates with the interior wall of housing 13 to form bubble discharge surfaces 42 disposed outward from the notch 41 for passing the fuel while discharging the bubbles produced at the downstream side of the contact portion 165 toward an upstream side thereof.

Figure 5:
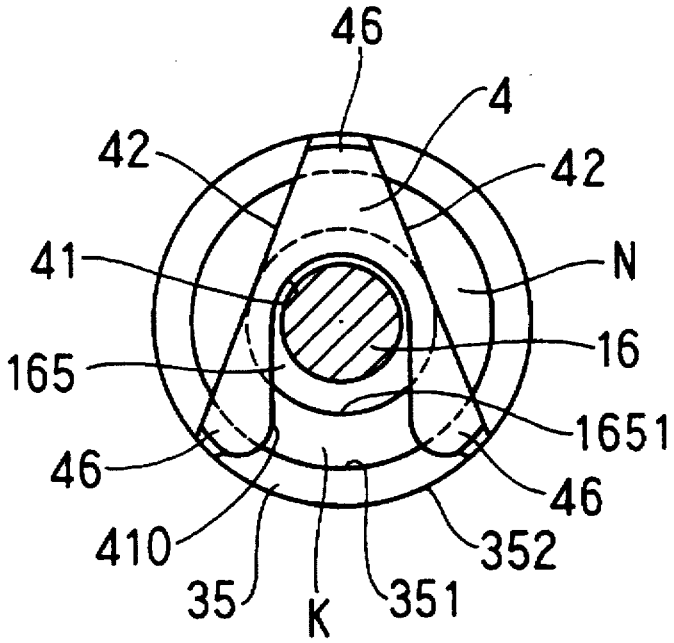
FIG. 5 is a radial cross-sectional view taken along line V—V of FIG. 2.
Figure 6:
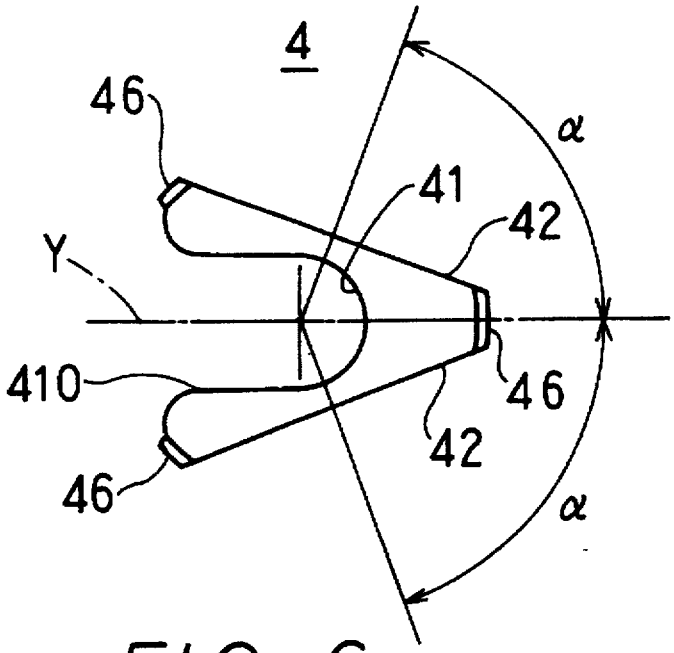
FIG. 6 is a plan view illustrating the stopper plate according to the first embodiment of the present invention.

As shown in FIGS. 5 and 6, the stopper plate 4 is generally in a V-shape and has the notch 41 opening in a radial direction to accommodate the needle 16 therein. The notch 41 has an opening portion 410 opening in the radial direction. The opening portion 410 is defined by its inside wall surface, and together with a contact portion periphery 1651 of the contact portion 165 and an inner periphery 351 of an opening end surface of the nozzle body 34, forms a passage K allowing fuel to flow therethrough.

The stopper plate 4 further includes two bubble discharge surfaces 42 having centers disposed on the left and right sides of the stopper plate 4 at equal angles $\alpha$ with respect to an axis Y of the notch 41. Each of the bubble discharge surfaces 42 is defined by a linear wall surface thereof and bridged by the inner periphery 351 of the opening end surface of the nozzle body 34. They collectively form a passage N permitting the flow of fuel therethrough.

At the outer portion between the notch 41 and each bubble discharge surface 42 and at an outer portion between the bubble discharge surfaces 42, the stopper plate 4 has three fixing portions 46. The contact portion 165 disposed on the needle 16 is positioned at the downstream side of the stopper plate 4 as shown in FIGS. 1, 2 and 5.

The bubble discharge surfaces 42 of the stopper plate 4 are effectively formed by notch portions at the outer periphery of the stopper plate 4. As shown in FIGS. 2 and 5, the bubble discharge surfaces 42 are formed more inward than the inner periphery 351 of the opening end surface 35 at the nozzle body 34 and extend outwardly from the inner periphery 351. When the stopper plate 4 is installed inside the housing 13, the outer periphery of the bubble discharge surfaces 42 is held by an inner wall of the housing 13 and extends to the outer periphery 352 of the opening end surface 35.

As shown in FIG. 1, the needle 16 has a flange portion 162 at a top thereof, a valve head 160 at a bottom thereof and the contact portion 165 at the top portion of the valve head 160. The flange portion 162, the valve head 160 and the contact portion 165 are formed integrally with the needle 16.

Figure 3:
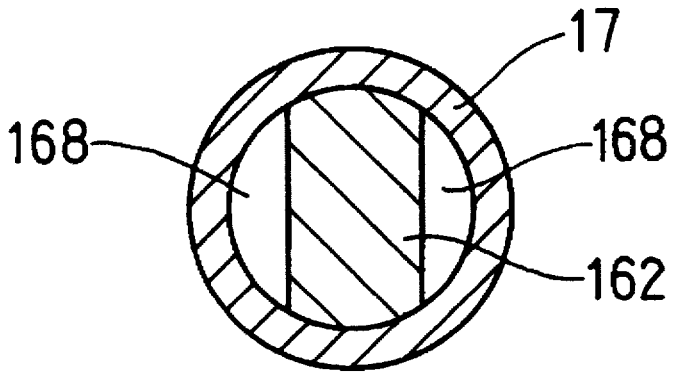
FIG. 3 is a radial cross-sectional view taken along line III—III of FIG. 1.

As shown in FIGS. 1 and 3, the flange portion 162 is fixed in a cylindrical movable iron core 17 and a fuel flow hole 168 is disposed therebetween. The movable iron core 17 is supported by the guide portion 123 at the top portion of the housing 13.

Figure 4:
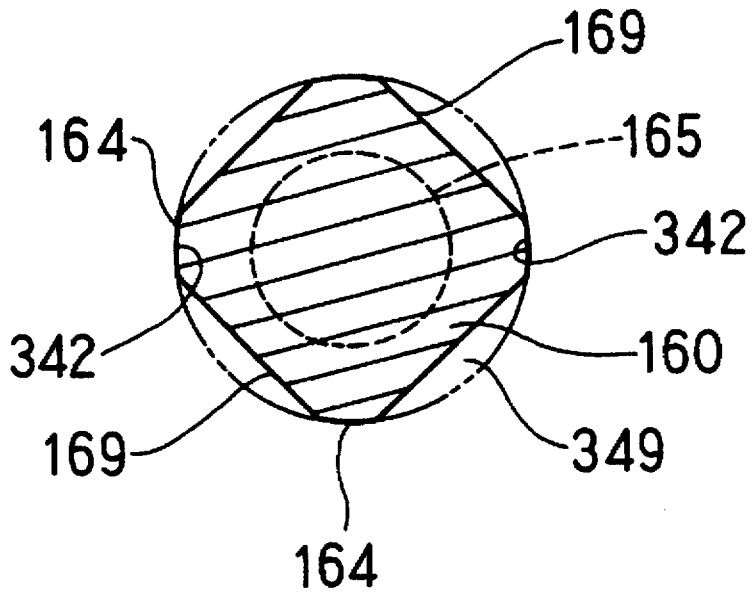
FIG. 4 is a radial cross-sectional view taken along line IV—IV of FIG. 2.

As shown in FIGS. 1, 2 and 4, the valve head 160 has a conical portion 163 contacting the valve seat 341 at the bottom end of the valve head 160 and four sliding surfaces 164 at a lower portion of the contact portion 165. The sliding surfaces 164 contact the guide portion 342 at the nozzle body 34.

The upper portion of the needle 16 is slidably supported by the guide portion 123 formed at an inner periphery of a non-magnetic pipe 12 at the upper portion of the housing 13 through the movable iron core 17, while the lower portion of the needle 16 is slidably supported by the guide portion 342 of the nozzle body 34. The stopper plate 4 is positioned between the guide portions 123 and 342.

The overall construction of the electromagnetic injection valve of the present embodiment is now explained. The electromagnetic injection valve includes an electromagnetic valve portion 10 and a nozzle portion 30.

The electromagnetic valve portion 10 has a ferromagnetic fixed iron core 11 with a hollow cylindrical shape. At a bottom end side of the electromagnetic valve portion 10, the non-magnetic pipe 12 having a hollow cylindrical shape is connected to a major diameter portion 121 of the electromagnetic valve portion 10 with a faucet joint.

Further, at an outer periphery of the bottom end of the non-magnetic pipe 12, the ferromagnetic housing 13 with a hollow cylindrical shape is connected to a step portion thereof with the faucet joint.

The housing 13 has a receiving portion 132 at a lower portion thereof and receives the stopper plate 4 and an upper portion of the nozzle body 34. A movable assembly including the needle 16 and the movable iron core 17 movable in the axial direction is disposed in a space formed by inserting the stopper plate 4 and extending from the fixed iron core 11 to the nozzle body 34. The needle 16 is positioned in the notch 41 through the opening portion 410 from the outer peripheral side of the stopper plate 4, and therefore, good operation performance is obtained.

A bottom end of a compressed spring 18 received inside the cylindrical fixed iron core 11 contacts a seat surface provided at an upper portion of the movable iron core 17. A top end of the spring 18 contacts an adjusting pipe 19 inserted into the fixed iron core 11. A filter 201 is disposed at a fuel inlet portion 20 of the fixed iron core 11.

As shown in FIGS. 1 and 2, the nozzle portion 30 has the nozzle body 34 and the valve head 160. The nozzle portion 30 has a seat 38 intermittently directing the fuel flow between the valve seat 341 and the conical portion 163 and a fuel injection nozzle 371 at the tip of the nozzle body 34.

Outside the fuel injection nozzle 371, a stainless steel orifice plate 31 having an orifice 310 and a resin nozzle sleeve 33 for protection are installed. The nozzle sleeve 33 has a concave portion 331 receiving the orifice plate 31 and an opening portion 333.

When the needle 16 rises and opens the valve, the contact portion 165 disposed on the needle 16 restricts the lift of the needle 16 in an upward direction to, e.g., 20μm by contacting the stopper plate 4.

The non-magnetic pipe 12 is disposed between the fixed iron core 11 and the magnetic housing 13. At the outer periphery of the non-magnetic pipe 12, an electromagnetic coil portion 21 is installed. The electromagnetic coil portion 21 has a resin spool 211 as a coil bobbin and a coil winding 212 wound around a periphery thereof. The coil winding 212 is connected to a connector terminal 214 through a lead wire 213 and the coil winding 212 and the connector terminal 214 are integrally molded as a synthetic resin unit 215.

Ferromagnetic plates 221 and 222 forming a magnetic passage from the outer periphery of the fixed iron core 11 to the outer periphery of the housing 13 are mounted outside the electromagnetic coil portion 21. The plates 221 and 222 are in a partial cylindrical shape and are disposed with a clearance therebetween in a circumferential direction thereof. An opening portion for inserting a projection covering the lead wire 213 of the electromagnetic coil portion 21 is made in a portion of the plate 221.

The casing of the electromagnetic injection valve completely covers the plates 221 and 222 and the electromagnetic coil portion 21 and is integrally molded as a synthetic resin cylinder 23 to form a connector portion 231 receiving the connector terminal 214. At the top end of the fixed iron core 11, a resin ring 232 for connection with a fuel delivery pipe is provided.

An operational effect of the present embodiment is explained below.

For actuating the electromagnetic injection valve, a voltage pulse corresponding to a fuel injection amount is supplied to the connector terminal 214 and thereby to the coil 212. As a result, the movable iron core 17 is attracted toward the fixed iron core 11 against the spring 18. Therefore, the contact portion 165 of the needle 16 moves until it contacts the stopper plate 4, a clearance is obtained between the seat 38 and the valve seat 341, and therefore, the fuel is injected into the combustion chamber.

The fuel passes through the filter 201, the inside of the fixed iron core 11, the inside of the adjusting pipe 19, the inside of the movable iron core 17, a fuel passage 168 (shown more clearly in FIG. 3) between the movable iron core 17 and the needle flange 162, the inside of the housing 13, the notch 41, the opening portion 410 and the bubble discharge surfaces 42 of the stopper plate 4 (shown in FIG. 5) and a fuel passage 349 (shown in FIG. 4) between the notch 169 of the valve head 160 and the guide portion 342 of the nozzle body 34 and reaches the conical portion 163 and is ejected from the orifice 310.

The present embodiment is remarkable because the bubble discharge surfaces 42 (shown in FIGS. 2 and 5) formed by cutting the outer periphery of the stopper plate 4 are made on the stopper plate 4 to help the fuel to flow together while discharging the bubbles. Therefore, the fuel bubbles produced at the downstream side of the stopper plate 4 can be discharged easily toward the upstream side of the stopper plate 4 using the bubble discharge surfaces 42. Thus, the bubbles are restrained from Staying at the downstream side of the stopper plate 4 and can be prevented from interrupting the fuel injection. Therefore, even when the bubbles are easily produced such as when the engine is started at a high temperature, fuel injection can be carried out normally and starting performance can be prevented from becoming more difficult.

The guides 123 and 342 supporting the needle 16 are provided in up and down directions from the position of the stopper plate 4. Therefore, the stopper plate 4 does not abut against the contact portion 165 and abrasion at contact surfaces thereof can be prevented.

The bubble discharge surfaces 42 are formed on the stopper plate 4 in the present embodiment at equal angles α on the left and right sides of the axis Y of the notch 41. Hence, when the electromagnetic fuel injection valve is mounted on the intake pipe at an inclination, either of the bubble discharge surfaces 42 or the opening portion 410 of the notch 41 is positioned at the upward side against an inclined surface, and therefore, the bubbles are easily discharged to the upstream side of the stopper plate 4.

When the stopper plate 4 is assembled in the housing 13, even though an angular position of the stopper plate 4 is not considered, since either passage is positioned upward, an assembly operation can be easily carried out. When the fuel injection valve is mounted on the intake pipe, any angular position can be used without restriction.

The stopper plate 4 is held by three fixing portions 46 between the housing 13 and the nozzle body 34 and areas of the fixing portions are small. Therefore, heat transmission to the stopper plate 4 from the housing 13 and the nozzle body 34 which is close to the high temperature engine can be reduced.

Further, inside the stopper plate 4, since the bubble discharge surface 42 are made across a wide range in a peripheral direction, the stopper plate 4 is formed by three-bridge-shaped portions extending from the outer periphery to the inner periphery thereof. Thus, the heat transmission from the outer periphery to the inner periphery is reduced and conduction of heat to the fuel can be restricted. As a result, a temperature increase at a contact portion between the contact portion 165 of the needle 16 and the stopper plate 4 is restrained. Thus, heating around the stopper plate 4 is lowered and the amount of bubbles produced around the stopper plate 4 can be very small.

A ratio (N/K) between an area N of the passage formed by one bubble discharge surface 42 and an area K of the passage formed by the opening portion 410 is 90%. Therefore, flowing the fuel and discharging the bubbles are easy. When the stopper plate 4 is in a disk shape, each of the areas is calculated as a clipped area cut from the stopper plate 4.

Figure 7:
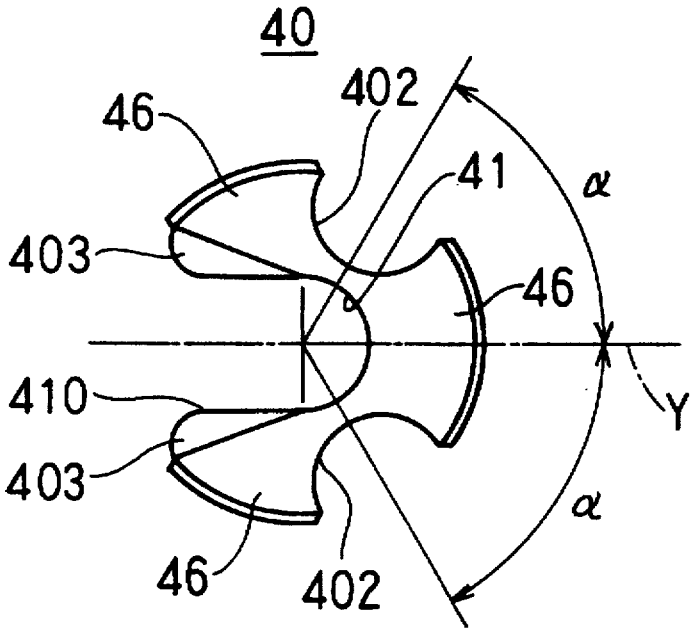
FIG. 7 is a plan view illustrating a stopper plate according to a second embodiment of the present invention.

In a second embodiment shown in FIG. 7, a stopper plate 40 has two bubble discharge surfaces 402 cut in a semicircle shape at an outer periphery portion thereof. The bubble discharge surfaces 402 are positioned at an equal angle α on both left and right sides of the axis Y. The ratio (N/K) in this embodiment is 50%. Further, at the outer portion of the opening portion 410, the stopper plate 4 decreases in thickness toward a downward side thereof to form a tapered portion 403 which helps the opening portion 410 accommodate the needle 16 easily.

The stopper plate 40 shown in FIG. 7 has the tapered portion 403 to insert the needle 16 easily. In this way, good assembly performance of the stopper plate 40 is obtained. Further, fuel flowing from the upstream side to the downstream side of the valve is fed toward the opening portion 410 by the tapered portion 403.

Figure 8:
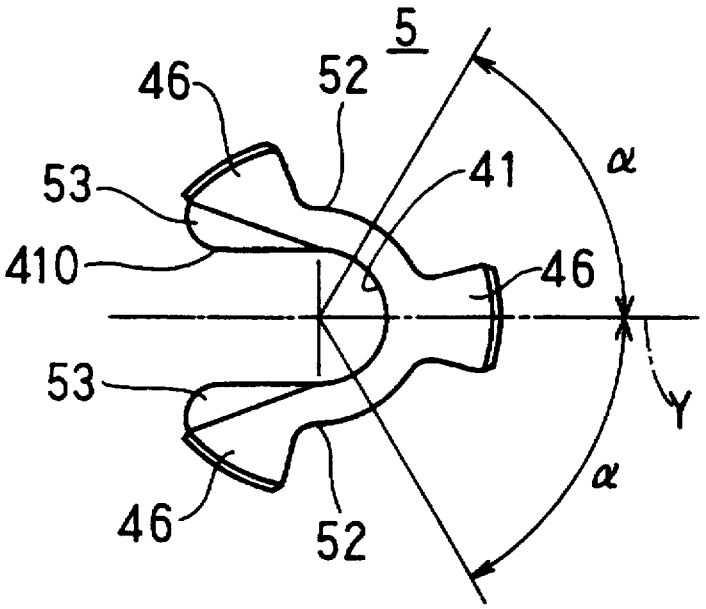
FIG. 8 is a plan view illustrating a stopper plate according to a third embodiment of the present invention.

In a third embodiment shown in FIG. 8, a stopper plate 5 has two bubble discharge surfaces 52 cut in a fan shape at an outer peripheral portion of the stopper plate 5. Bubble discharge surfaces 52 are formed at equal angles α on the left and right sides of the axis Y of the notch 41. The ratio (N/K) in this embodiment is 60%. Further, at the outer portion of the opening portion 410, the stopper plate 5 decreases in thickness toward a downward side thereof to form a tapered portion 53 which helps the opening portion 410 accommodated the needle 16 easily.

The stopper plate 5 shown in FIG. 8 has the tapered portion 53 to insert the needle 16 easily and good assembly performance is obtained in this way. Further, since a portion of the plate 5 surrounding the notch 41 is formed in a ring shape having uniform thickness throughout the stopper plate 5, enough strength for restricting a movement of the needle 16 can be obtained.

Figure 9:
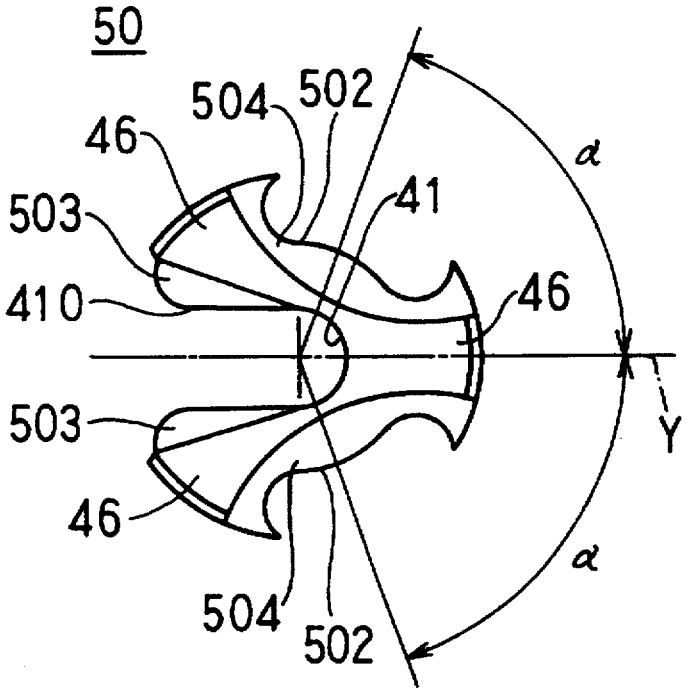
FIG. 9 is a plan view illustrating a stopper plate according to a fourth embodiment of the present invention.

In a fourth embodiment shown in FIG. 9, a stopper plate 50 has two bubble discharge surfaces 502 cut in a U-shape at an outer peripheral portion of the stopper plate 50. The bubble discharge surfaces 502 are formed at equal angles α on the left and right sides of the axis Y of the notch 41. The ratio (N/K) in this embodiment is 55%. Further, at the outer portion of the opening portion 410, the stopper plate 50 decreases in thickness toward a downward side thereof to form a tapered portion 503 which helps the opening portion 410 accommodate the needle 16 easily.

As shown in FIGS. 7 through 9, the stopper plates 40, 5, 50 in the second through fourth embodiments, respectively are similar to the stopper plate 4 in the first embodiment except for above-described details. Therefore, similar effects as in the first embodiment can be obtained in those embodiments.

The stopper plate 50 shown in FIG. 9 has the tapered portion 503 to help accommodate the needle 16 easily and good assembly performance is obtained in this way. The fuel flow is fed by the tapered portion 503. Further, in FIG. 9, a thickness of a portion surrounding the notch 41 is wider than that in FIG. 8 so that more strength of that portion can be obtained. Since the tapered portion 504 is made to help the fuel to flow smoothly from the upstream side to the downstream side even though the thickness is greater, fuel injection can be carried out smoothly.

Figure 10:
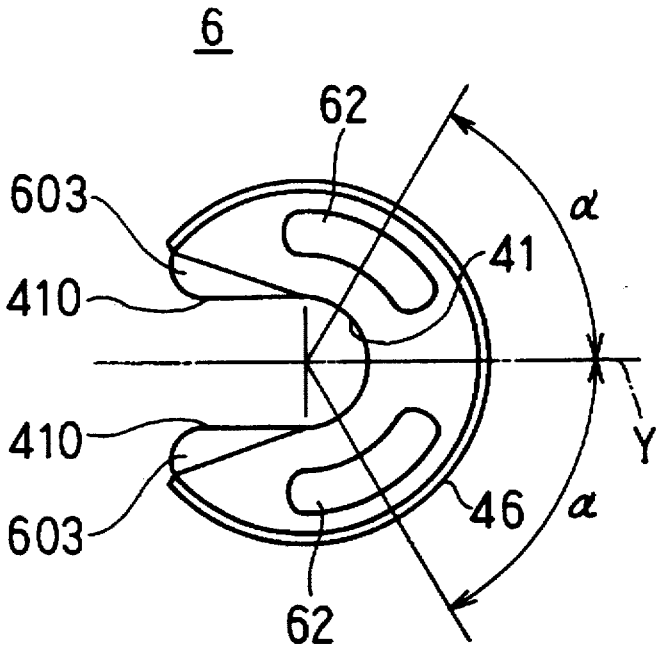
FIG. 10 is a plan view illustrating a stopper plate according to a fifth embodiment of the present invention.

In a fifth embodiment shown in FIG. 10, a stopper plate 6 has a slot-shaped bubble discharge holes 62 defined by bubble discharge surfaces. The bubble discharge holes 62 are formed at equal angles α on left and right sides of the axis Y of the opening portion of the notch 41. The ratio (N/K) is 60%. The stopper plate 6 has tapered portions 603 to help accommodate the needle 16 easily.

Since the stopper plate 6 in the fifth embodiment has the slot-shaped bubble discharge holes 62, strength throughout the stopper plate 6 is high. Further, since the needle 16 is easily inserted with the tapered portion 603, good assembly performance is obtained. The fuel flow is fed by the taper portion 603.

The bubble discharge holes 62 in the fifth embodiment extend from the inner side to the outer side of the inner periphery 351 of the opening end surface 35 of the nozzle body 34. Therefore, the bubbles passing up through the inside wall of the nozzle body 34 can smoothly escape upward and the bubbles are restrained from staying a corner portion formed between the nozzle body 34 and the stopper plate in the first through fifth embodiments.

Figure 11:
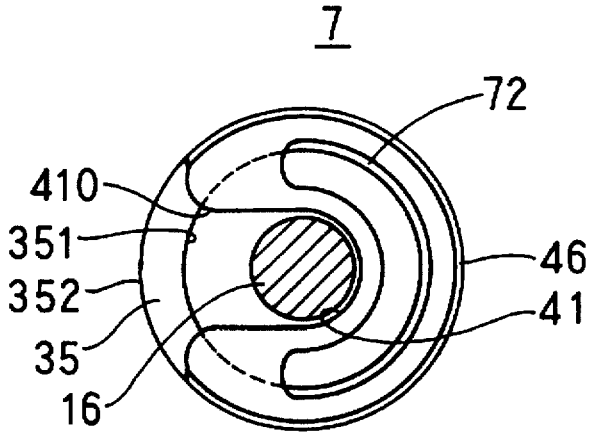
FIG. 11 is a plan view illustrating a stopper plate according to a sixth embodiment of the present invention.

In a sixth embodiment shown in FIG. 11, only one bubble discharge hole 72 is formed on a stopper plate 7 by a bubble discharge surface. A total length of the bubble discharge hole 72 in a circumferential direction is larger than its width in a radial direction. The bubble discharge hole 72 is symmetrically disposed with respect to the opening portion 410. The ratio (N/K) in this embodiment may range from 50 to 110%. The stopper plate 7 is disposed between top and bottom guide portions 123 and 342, respectively. Like the fifth embodiment, the bubble discharge hole 72 in this embodiment straddles the inner surface 351, thereby permitting bubbles to freely flow upward. Also, since the total length of the hole 72 is greater than its width, the flow of bubbles therethrough is enhanced even more.

Figure 12:
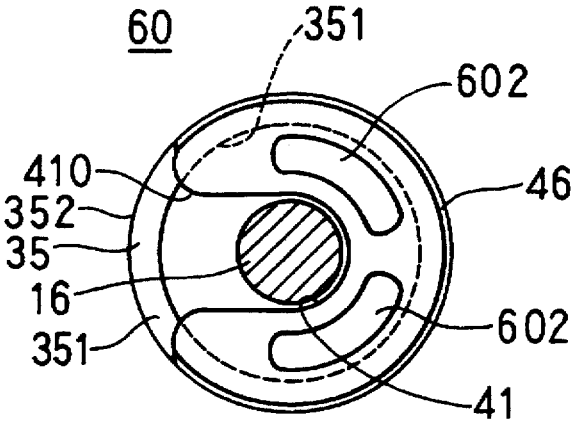
FIG. 12 is a plan view illustrating a stopper plate according to a seventh embodiment of the present invention.

In a seventh embodiment shown in FIG. 12, a plurality of bubble discharge holes 602 are formed on a stopper plate 60 by bubble discharge surfaces and a total length of bubble escaping holes 602 in a circumferential direction is larger than the width of any one bubble discharge hole in a radial direction. The bubble discharge holes 602 are symmetrically disposed about the axis of the opening portion 410. The ratio (N/K) in this embodiment may range from 50 to 110%. The stopper plate 60 is disposed between top and bottom guide portions 123 and 342, respectively. Unlike the fifth and sixth embodiments, the bubble discharge holes 602 in the seventh embodiment do not span across the inner surface 351; therefore, bubble flow therethrough is not as free. This embodiment, however, has improved strength around its peripheral portion due to the increased thickness there.

Figure 13:
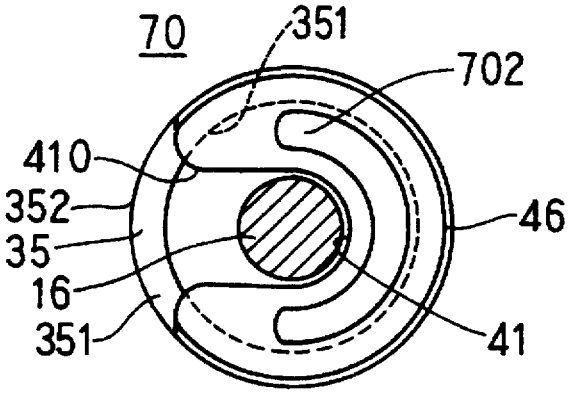
FIG. 13 is a plan view illustrating a stopper plate according to an eighth embodiment of the present invention.
Figure 14:
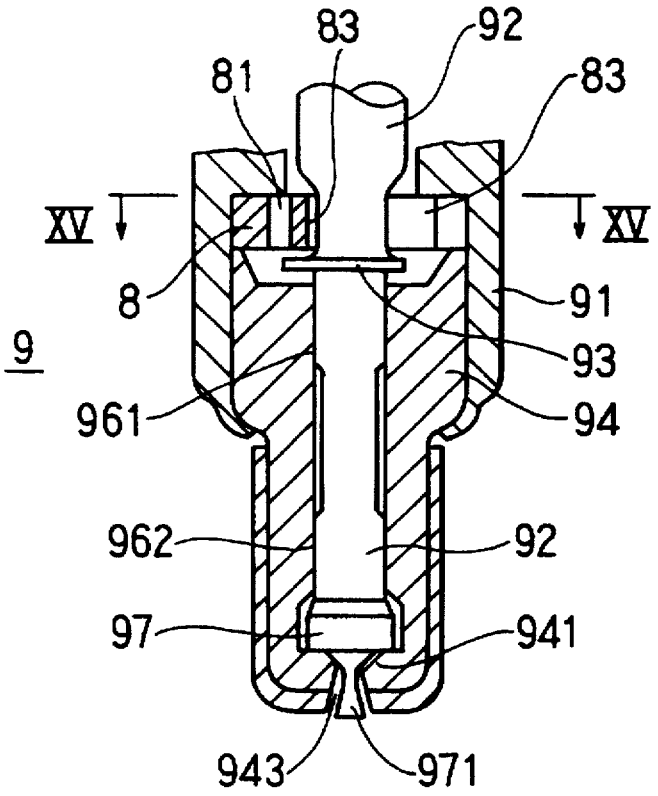
FIG. 14 PRIOR ART
FIG. 14 is a longitudinal cross-sectional view illustrating a conventional electromagnetic injection valve.
Figure 15:
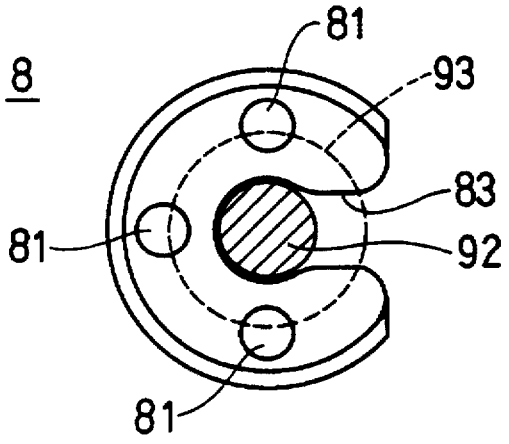
FIG 15 PRIOR ART
FIG. 15 is a radial cross-sectional view taken along line XV—XV of FIG. 14.
Figure 16:
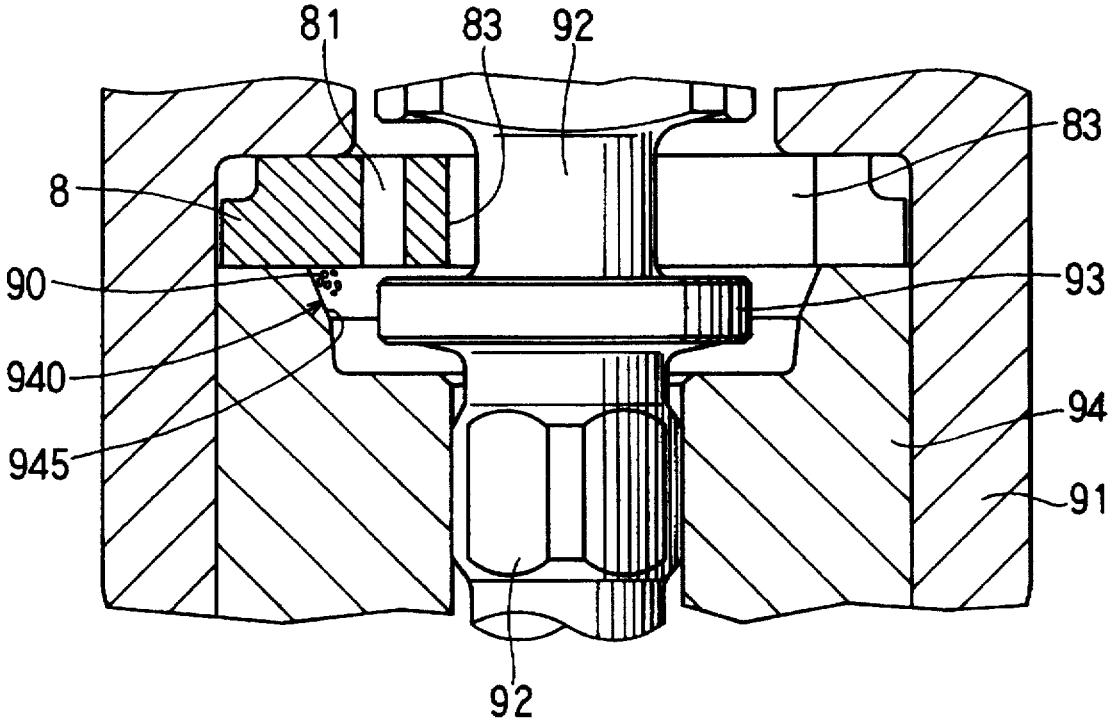
FIG. 16 PRIOR ART
FIG. 16 is a longitudinal cross-sectional view illustrating a problem in the conventional electromagnetic injection valve.

In an eighth embodiment shown in FIG. 13, only one bubble discharge hole 702 is formed on a stopper plate 70 by a bubble discharge surface and a total length of the bubble discharge holes in a circumferential direction is larger than width in a radial direction. The bubble discharge hole 702 is symmetrically disposed about the axis of the opening portion 410. The ratio (N/K) in this embodiment may range from 50 to 110%. The stopper plate 702 is disposed between top and bottom guide portions 123 and 342, respectively. Like the seventh embodiment, the bubble discharge hole 702 in this embodiment does not overlap the inner surface 351; however, its additional peripheral position thickness increases the strength of the stopper plate 70.

The present invention having been described should not be limited to the disclosed embodiments, but it may be modified in many other ways without departing from the scope and the spirit of the invention. Such changes and modifications are to be understood as being included within the scope of the present invention as defined by the appended claims.

What is claimed is:

1. An electromagnetic injection valve capable of controlling fuel flow on an upstream side of said valve by selectively opening and closing a valve seat on a downstream side of said valve to discharge fuel therefrom, said electromagnetic injection valve comprising:

a housing including a nozzle body on an end of said valve from which fuel may be discharged, said nozzle body having an interior surface defining an interior of said nozzle body;

a needle disposed in said housing, said needle having a valve head disposed to open and close said valve seat;

an electromagnetic coil portion disposed in said housing, said coil portion being capable of actuating said needle electromagnetically and displacing said needle along an axis thereof, said needle including a contact portion; and a stopper plate disposed at an end surface of said nozzle body to abut said valve head when said valve seat is open, said stopper plate having a notch accommodating said needle, an opening portion of said notch opening from said notch in a radial direction of said stopper plate and disposed to pass fuel from said upstream side to said downstream side, and a first bubble discharge surface extending from an interior of said nozzle body to a side of said interior surface opposite said nozzle body interior, thereby forming, in conjunction with said side of said interior surface opposite said nozzle body interior, a first bubble discharge hole crossing an inner peripheral edge of said end surface of said nozzle body to pass fuel from said upstream side to said downstream side and to pass bubbles produced at a downstream side of said stopper plate to an upstream side thereof.

2. The electromagnetic valve of claim 1, further comprising at least one additional bubble discharge surface extending from said interior of said nozzle body to said side of said interior surface opposite said nozzle body interior, thereby forming, in conjunction with said side of said interior surface opposite said nozzle body interior, a second bubble discharge hole crossing said inner peripheral edge of said end surface of said nozzle body, said at least one additional bubble discharge surface being distinct from said first bubble discharge surface, said first bubble discharge surface and said at least one additional bubble discharge surface constituting a plurality of bubble discharge surfaces.

3. The electromagnetic valve of claim 2, wherein a length of said bubble discharge holes in a circumferential direction of said stopper plate is greater than a radial width of a bubble discharge hole in a radial direction of said stopper plate.

4. The electromagnetic valve of claim 3, wherein said plurality of bubble discharge holes are symmetrically disposed about an axis of said opening portion.

5. The electromagnetic valve of claim 4, wherein a ratio of an area of each of said bubble discharge holes to an area of said notch is from 50% to 110%.

6. The electromagnetic valve of claim 5, further comprising:

an upstream guide portion and a downstream guide portion disposed on an upstream side and a downstream side, respectively, of said stopper plate.

7. An electromagnetic injection valve capable of controlling fuel flow on an upstream side of said valve by selectively opening and closing a valve seat on a downstream side of said valve to discharge fuel therefrom, said electromagnetic injection valve comprising:

a housing including a nozzle body on an end of said valve from which fuel may be discharged, said nozzle body having an interior surface defining an interior of said nozzle body;

a needle disposed in said housing, said needle having a valve head disposed to open and close said valve seat;

an electromagnetic coil portion disposed in said housing, said coil portion being capable of actuating said needle electromagnetically and displacing said needle along an axis thereof, said needle including a contact portion; and a stopper plate disposed at an end surface of said nozzle body to abut said valve head when said valve seat is open, said stopper plate having a notch accommodating said needle, an opening portion of said notch opening from said notch in a radial direction of said stopper plate and disposed to pass fuel from said upstream side to said downstream side, and a bubble discharge hole crossing an inner peripheral edge of said end surface of said nozzle body to pass fuel from said upstream side to said downstream side and to pass bubbles produced at a downstream side of said stopper plate to an upstream side thereof.

8. The electromagnetic valve of claim 7, wherein:

said stopper plate includes only one bubble discharge hole.

9. The electromagnetic valve of claim 8, wherein a length of said bubble discharge hole in a circumferential direction of said stopper plate is greater than a radial width thereof in a radial direction of said stopper plate.

10. The electromagnetic valve of claim 9, wherein said bubble discharge hole is symmetrically disposed about an axis of said opening portion.

11. The electromagnetic valve of claim 10, wherein a ratio of an area of said bubble discharge hole to an area of said notch is from 50% to 110%.

12. The electromagnetic valve of claim 11, further comprising:

an upstream guide portion and a downstream guide portion disposed on an upstream side and a downstream side, respectively, of said stopper plate.

13. The electromagnetic valve of claim 7, wherein a length of said bubble discharge hole in a circumferential direction of said stopper plate is greater than a radial width of a bubble discharge hole in a radial direction of said stopper plate.

14. The electromagnetic valve of claim 13, wherein said bubble discharge hole is symmetrically disposed around an axis of said opening portion.

15. The electromagnetic valve of claim 14, wherein a ratio of an area of each of said bubble discharge holes to an area of said notch is from 50% to 110%.

16. The electromagnetic valve of claim 15, further comprising an upstream guide portion and a downstream guide portion disposed on an upstream side and a downstream side, respectively, of said stopper plate.

* * * * *